United States Patent [19]

Yen

[11] Patent Number: 4,696,081

[45] Date of Patent: Sep. 29, 1987

[54] CLIP RESILIANT

[76] Inventor: Down W. Yen, No. 654, Wu Chia 2nd Road, Feng Shan City, Kaohsiung Hsine, Taiwan

[21] Appl. No.: 870

[22] Filed: Jan. 6, 1987

[51] Int. Cl.[4] ..... B42F 1/04

[52] U.S. Cl. ..... 24/558; 24/67.5; 24/565

[58] Field of Search ..... 24/508, 553, 554, 557, 24/558, 565, 67.3, 67.5, 67.9; 40/11 R, 23 R, 23 A; D8/395; D19/86

[56] References Cited

U.S. PATENT DOCUMENTS

| | | | |
|---|---|---|---|
| 1,150,073 | 8/1915 | Spengler | 24/565 |
| 1,965,554 | 7/1934 | Mainwaring | 24/558 |
| 2,259,505 | 10/1941 | Wisdom | 24/558 X |

FOREIGN PATENT DOCUMENTS

| | | | |
|---|---|---|---|
| 169310 | 9/1921 | United Kingdom | 24/558 |
| 216393 | 5/1924 | United Kingdom | 24/67.5 |
| 344187 | 3/1931 | United Kingdom | 24/558 |

*Primary Examiner*—Kenneth J. Dorner
*Assistant Examiner*—James R. Brittain
*Attorney, Agent, or Firm*—Bacon & Thomas

[57] ABSTRACT

A clip comprising: a metal sheet which forms an upper face, a lower face and a back portion; two pairs of hinges with one pair on each face; two pairs of shanks with each shank having a longer arm and a shorter arm, the ends of the arms are bent so that they are rotatably retained by corresponding pairs of hinges. The hinges are set diagonally on the upper and lower faces so that the shanks can be flipped to a position 90 degrees from its original (upright) position and vice-versa.

1 Claim, 5 Drawing Figures

CLIP RESILIANT

BACKGROUND OF THE INVENTION

This invention relates to an improved clip structure, and more particularly, to a structure which provides a clipping means for paper or documents that is more convenient for someone to consult or read the clipped material.

A nation's standard of living roughly parallels its per capita consumption of pulp and paper. Each day every person in the U.S. uses almost 1 pound of paper, which is much more than is used in any other country. The rapid growth in demand for paper shows no sign of slowing down. Likewise, the demand for clips also increases. A modified or improved clip is, therefore, welcomed by those who are handling a thick pile of paper or documents.

In conventional designs, the main body of a clip is usually made of a resilient metal sheet while the shank is made of metal strip. The main body is triangular in shape when viewed from the side. The two ends of the main body are rolled or folded to produce four hinges. The ends of the two shanks are inserted into those hinges with the ends of one shank being inserted into the two hinges at the upper face and the ends of other shank being inserted into the other two hinges at the lower face. The two arms of the shanks are mirror images of each other and are disposed perpendicularly to the clip end. When utilized, these shanks are pressed in such a way that a gap appears between the two clip ends. Paper or documents can then be inserted into the space and clipped once the pressure exerted on the shanks is released.

The conventional clip has the following drawbacks:

1. The two shanks of the clip must be flipped down when the clipped paper or documents are filed. Otherwise, the shanks protruding out from the top of the file would be unpleasant in appearance and inconvenient to handle;

2. The upper shanks of the clip must be flipped up when someone wants to read the clipped paper or documents. Otherwise, the reading of the first several lines of the content will be hindered by the down-flipped shank;

3. Even though the upper shank has been flipped up when someone is reading the clipped paper or documents, the situation is still far from perfect. The up-flipped shank protruding out from the main body is a hindrance when one is turning from one page to another page;

4. As a result of the third drawback, the user often unclips the clip while reading and clips it again after reading. This actually results in another troublesome drawback; and 5. The four hinges of the clip are formed by rolling or folding the upper and lower edges of the main body (metal sheet). This method wastes material and is considered to be uneconomical.

SUMMARY OF THE INVENTION

A primary objective of this invention is to provide a clip which is more convenient to utilize.

Another objective of this invention is to provide a clip of which the shanks can be flipped 90 degrees from its original (upright) position.

A further objective of this invention is to provide a clip which is economical to manufacture.

Further objectives and advantages of the present invention will become apparent as the following description proceeds.

DETAILED DESCRIPTION OF THE INVENTION

Figure 1:
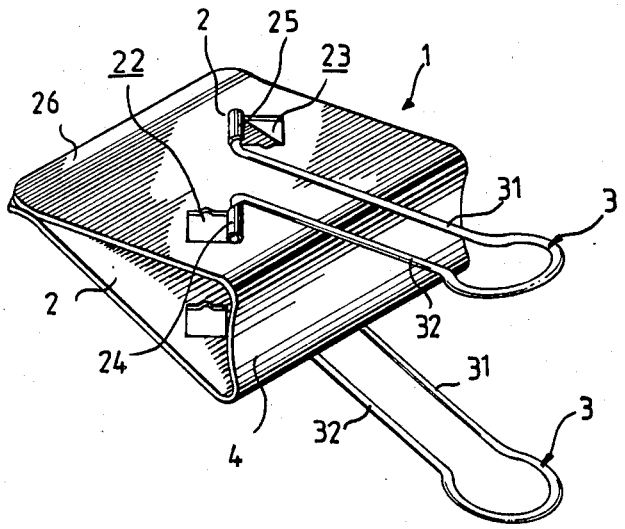
FIG. 1 is a perspective view of the improved clip structure of the present invention.

As can be seen in FIG. 1, the present invention 1 comprises a thin metal sheet and a pair of metal shanks 3. The metal sheet possesses moderate resiliency and is roughly triangular in shape when viewed from a side (refer to FIG. 3). Said metal sheet forms an upper and lower face 2 as well as a back portion 4. Said back portion 4 connects the upper and lower faces 2. The upper and lower faces 2 normally contact each other at the front ends (i.e. the end opposite the back portion).

Consider the upper face 2, it is provided with two holes, a first hole 22 and a second hole 23, as well as two hinges, a right hinge 24 and a left hinge 25. These hinges, 24 and 25, are formed by first cutting two areas of roughly rectangular shape at two suitable positions on the face. For each area, one edge remains uncut. The cut-out area on right-hand side is disposed nearer to the back portion 4 with its uncut edge facing the back portion 4. The cut-out metal sheet is rolled or folded to form the right hinge 24 and leaves a first hole 22 immediately adjacent to the hinge 24. The cut-out area on left-hand side is disposed nearer to one of the clip edges 26 with its uncut edge facing said clip edge 26, the cut-out metal sheet is rolled or folded to form the left hinge 25 and leaves a second hole 23 immediately adjacent to the hinge 25. The two hinges 24 and 25 are arranged in such a way that an imaginary line running through the centerline of the right hinge 24 and left hinge 25 forms a 45 degree angle with the clip end 26. In other words, the hinges are set diagonally on the upper face 2. The situation is identical on the lower face 2 except that the direction is reversed and a mirror image of the upper face is observed.

Figure 2:
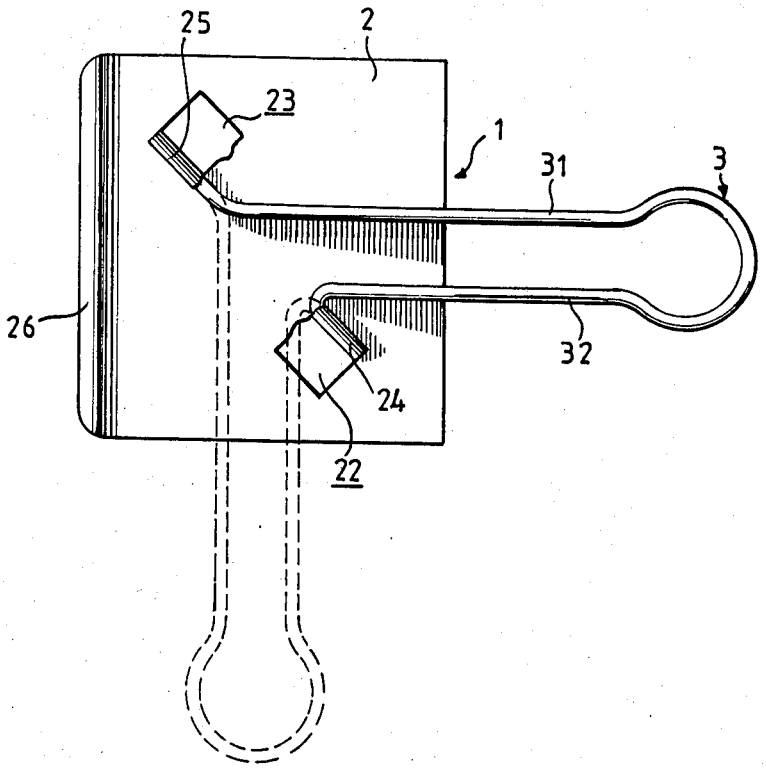
FIG. 2 is a top view of the present invention.

Two shanks 3 are inserted into said two pair of hinges 24 and 25. Each of the shanks 3, being made of thick gauge metal wire, comprises two parallel arms, 31 and 32, with a circular portion connecting the longer arm 31 and the shorter arm 32. The two arms 31, 32 are not identical in length or shape (refer to FIG. 2). Consider the upper face 2 with the upper clip edge 26 at the bottom, the longer arm 31 is on the left while the shorter arm 32 is on the right. The ends of the two arms are bent outward to an angle of 45 degrees clockwise for the longer arm 31 and 135 degrees counterclockwise for the shorter arm 32. The bending angles are determined in such a way that the two arms 31, 32 can rotatably retained by their corresponding hinges, 25 and 24. The longer arm 31 is inserted into a hinge 25 and shorter arm 32 is inserted into another hinge 24. When viewed from the bottom, the situation is identical except that the direction is reversed and a mirror image of the upper face is observed.

Figure 3:
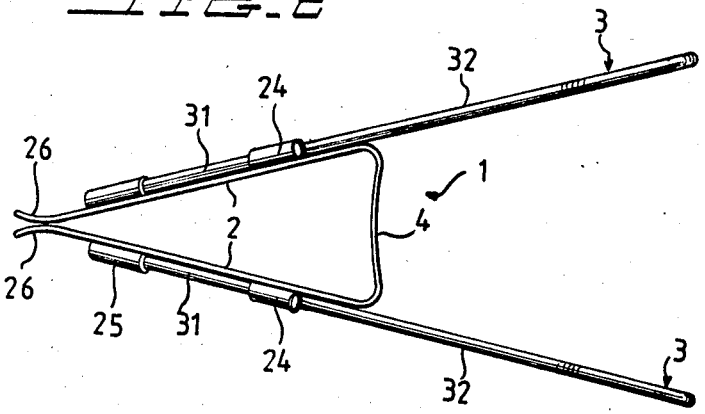
FIG. 3 is a side elevational view thereof.
Figure 4:
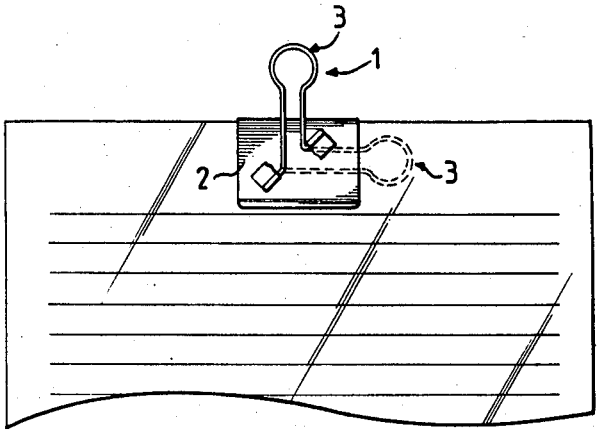
FIG. 4 is a top plan view showing a working embodiment of the present invention.

Referring to FIGS. 3 and 4, it can be seen that in order to utilize the present clip, one should press the two shanks 3 toward each other so as to separate the clip edges 26. Paper or documents can be inserted into the space between the upper and lower faces, 1 and 2, and can be clipped when the pressure exerted on the shanks 3 is released.

Figure 5:
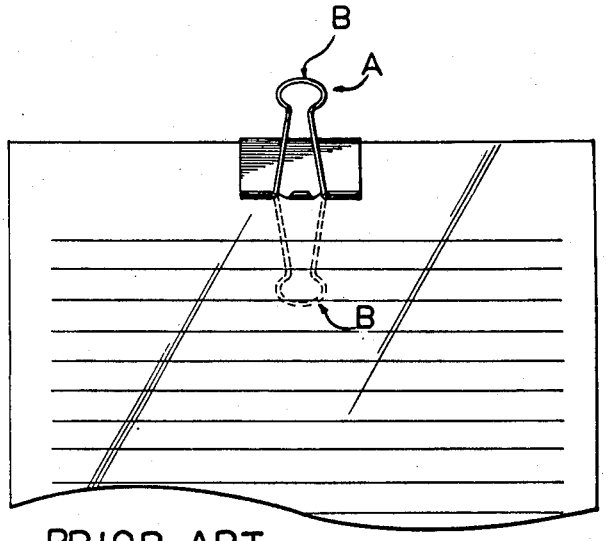
PRIOR ART FIG. 5
FIG. 5 is a top plan view showing a working embodiment of a conventional clip structure.

More importantly, the shanks 3 in the present improved clip can be flipped aside (refer to FIG. 4). In other words, the shanks 3, because of their unique diagonal positioning, can be turned 90 degrees from their upright position about the axis of the hinges. This is unlike a conventional clip A, wherein the shanks B can only be flipped upward or downward (refer to FIG. 5). The unique 'flip aside' feature of the present invention allows the shanks to be conveniently flipped to one side, thereby preventing the problem of shanks protruding out from the file or papers which the clip is holding. Also this 'flip aside' feature allows a clipped paper to be read without unclipping the paper.

While in accordance with the patent statutes, a best mode and preferred embodiment has been set forth in detail, the scope of the invention is not limited thereby, but rather by the scope of the attached claims.

I claim:

1. An improved clip structure comprising:

a resilient metal sheet forming an upper face, a lower face and a back portion connecting said upper face and said lower face, the upper and lower face normally contacting each other at the front ends thereof;

two pairs of hinges with a first pair of hinges on said upper face and a second pair of hinges on said lower face, said first and second pairs of hinges respectively defining hinge axes for pivotal movement lying parallel to said respective upper and lower faces set diagonally on said upper and lower faces relative to said back portion so that one hinge of each of said two pairs is closer to said back portion than the other;

a first and a second shank, said first shank being positioned on said upper face and second shank being positioned on said lower face, each of said shanks having a longer arm and a shorter arm, the ends of said longer arms having portions pivotally retained by the hinges adjacent to the edges of the clip structure and said shorter arms having portions pivotally retained by the hinges adjacent to the back portion of the clip structure, said shanks being pivotable 90 degrees from an extending upright position beyond said back portion about the axes respectively formed by said first and second pairs of hinges to a position substantially parellel to said back portion.

* * * * *